United States Patent [19]

Kure-Jensen et al.

[11] Patent Number: 4,853,552

[45] Date of Patent: Aug. 1, 1989

[54] STEAM TURBINE CONTROL WITH MEGAWATT FEEDBACK

[75] Inventors: Jens Kure-Jensen, Schenectady; Bernd A. K. Westphal, Clifton Park, both of N.Y.; Thane M. Drummond, Roanoke, Va.

[73] Assignee: General Electric Company, Schenectady, N.Y.

[21] Appl. No.: 175,079

[22] Filed: Mar. 30, 1988

[51] Int. Cl.[4] ..... F01D 17/04

[52] U.S. Cl. ..... 290/40 C; 290/40 R

[58] Field of Search ..... 290/40 R, 40 B, 40 C, 290/52

[56] References Cited

U.S. PATENT DOCUMENTS

| | | | |
|---|---|---|---|
| 3,959,635 | 5/1976 | Tanco | 290/40 R X |
| 4,029,951 | 6/1977 | Berry et al. | 290/40 R X |
| 4,120,159 | 10/1978 | Matsumoto et al. | 290/40 C X |
| 4,179,742 | 12/1979 | Stern et al. | 290/40 R X |
| 4,329,592 | 5/1982 | Wagner et al. | 290/40 R |
| 4,450,363 | 5/1984 | Russell et al. | 290/40 C |
| 4,746,807 | 5/1988 | Furo et al. | 290/40 C |

*Primary Examiner*—William M. Shoop, Jr.
*Assistant Examiner*—W. E. Duncanson, Jr.
*Attorney, Agent, or Firm*—Jerome C. Squillaro

[57] ABSTRACT

A signal representing the electrical output power of a steam turbine-generator is fed back to a control system. A signal representing the boiler steam pressure is also fed to the control system. A control signal for controlling valves feeding steam to the steam turbine is gain controlled between one and zero in the presence of a negative rate of change of steam pressure less than a predetermined value. At other negative and all positive values of rate of change of steam pressure, the control signal is unaffected. In one embodiment, a linear relationship is employed for controlling the gain for increasingly negative values of the rate of change of steam pressure. At an extreme negative value, the gain is controlled to zero, whereby the a load reference signal remains unchanged.

4 Claims, 2 Drawing Sheets

STEAM TURBINE CONTROL WITH MEGAWATT FEEDBACK

BACKGROUND OF THE INVENTION

The present invention relates to steam turbines and, in particular, to control of steam turbine-generators during generator loading following a cold startup.

When a steam turbine-generator is started from a cold start, it takes a substantial time to generate a full operating steam supply. During early stages of startup, the generator is brought up to synchronous speed and loaded lightly. Synchronous speed is defined as a speed at which the frequency and phase of the electricity produced by the generator matches that of the network or load to which it will be connected. After synchronous speed is attained, the electrical output of the generator is connected to the load and loading toward full output can begin. While ramping up the loading, the steam turbine may require a greater steam flow than the boiler is capable of supplying. When this happens, the steam pressure may decline.

One type of control system programs the loading of the turbine-generator by comparing a commanded megawatt output of the generator with the actual output of the generator to produce an error signal. This error signal is used, either directly or after further processing, to control steam valves feeding steam admitted to the turbine. As noted above, during the startup and loading process, less than the full operational supply of steam is available from the boiler. Accordingly, it is possible that, steam pressure perturbations may occur during loading. If a sharp downward swing occurs in the steam pressure, the control system sharply opens the steam valves to compensate by attempting to increase the supply of steam to the turbine. However, since a limited supply of steam is available, rapidly opening the steam valves, instead of increasing the steam fed to the turbine, further reduces the available steam pressure. The reduced steam pressure causes the error signal to open the steam valves even wider, which, due to the limited steam supply available, further reduces the steam pressure. These effects tend to reinforce each other as positive feedback to increase the instability of the system.

OBJECTS AND SUMMARY

It is an object of the invention to provide a steam turbine-generator control system which overcomes the drawbacks of the prior art.

It is a still further object of the invention to provide a steam turbine-generator control system wherein an error signal is modulated according to a negative slope in steam pressure.

It is a still further object of the invention to provide a steam turbine-generator control system wherein a gain applied to an error signal for controlling steam admitted to the generator is proportional to a slope of a negative rate of change in steam pressure.

Briefly stated, the present invention provides an apparatus wherein a signal representing the electrical output power of a steam turbine-generator is fed back to a control system. A signal representing the boiler steam pressure is also fed to the control system. A control signal for controlling valves feeding steam to the steam turbine is gain controlled between one and zero in the presence of a negative rate of change of steam pressure less than a predetermined value. At other negative and all and positive values of rate of change of steam pressure, the control signal is unaffected. In one embodiment, a linear relationship is employed for controlling the gain for increasingly negative values of the rate of change of steam pressure. At an extreme negative value, the gain is controlled to zero, whereby the control signal remains unchanged.

According to an embodiment of the invention, there is provided a control system for controlling a steam turbine-generator using megawatt feedback, comprising: means for producing a load reference error, control means responsive to the load reference error for controlling an amount of steam fed to the turbine, means for producing a rate of change signal responsive to a rate of change of a steam pressure in the steam turbine-generator, and gain control means responsive to a value of the rate of change signal indicating a negative rate of change less than a predetermined value for reducing the load reference error, whereby a response of the steam turbine-generator is rendered relatively unresponsive to steam-pressure reductions exceeding the predetermined value.

According to a feature, there is provided a method for controlling a steam turbine-generator using megawatt feedback, comprising: producing a load reference error, controlling an amount of steam fed to the turbine responsive to the load reference error, producing a rate of change signal responsive to a rate of change of a steam pressure in the steam turbine-generator, and reducing the load reference error responsive to a value of the rate of change signal indicating a negative rate of change less than a predetermined value, whereby a response of the steam turbine-generator is rendered relatively unresponsive to steam-pressure reductions exceeding the predetermined value.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
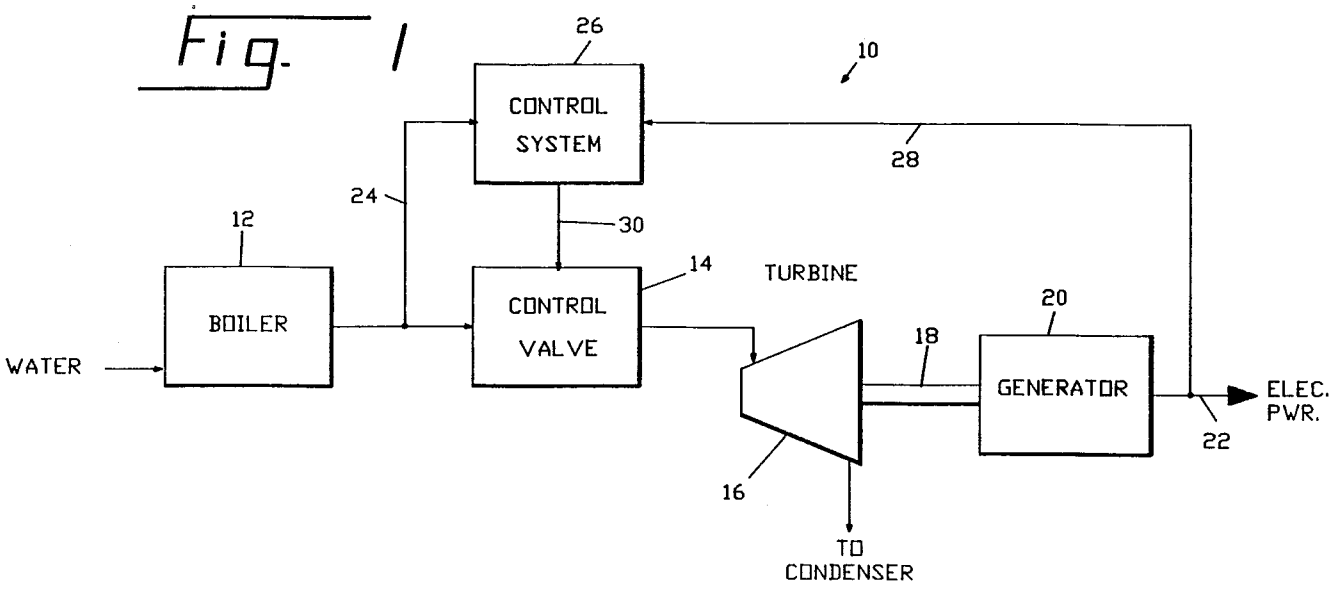
FIG. 1 is a simplified schematic diagram of a steam turbine-generator system to which reference will be made in explaining the present invention.

Referring now to FIG. 1, there is shown, generally at 10, a steam turbine-generator system according to an embodiment of the invention. A boiler 12 converts water to high-pressure steam for delivery through a steam control valve 14 to a steam turbine 16. Expansion of the steam in steam turbine 16 produces a mechanical torque on a shaft 18 for rotating a rotor of an electric generator 20. Electric generator 20 generates a supply of electricity, conventionally alternating current for application on an output line 22 to a load (not shown). A signal representing a steam pressure at an outlet of boiler 12 is applied on a steam pressure feedback line 24 to a control system 26. A signal representing the power output being fed to output line 22 is applied on a megawatt output feedback line 28 to control system 26. A control signal is applied on a control line 30 from control system 26 to steam control valve 14. Steam control valve 14 is responsive to the signal on control line 30 for opening and closing to control the amount of steam fed to steam turbine 16.

Before continuing, it is worth noting that the illustration in FIG. 1 is highly schematic. A real turbine-generator system is considerably more complex than the schematically illustrated system. For example, boiler 12 may include several stages of initial heating and reheating, steam control valve 14 may include all of the many valves required for startup and control of steam turbine 16, and steam turbine 16 may be a multi-stage turbine with reheating between stages. Finally, the simple feedback and control signals shown associated with control system 26 are augmented, in a real-world system, with many more input and output signals as well as substantial internal analog and/or digital processing. For purposes of describing the present invention, however, the highly schematic illustration is considered appropriate to a full understanding of the present invention by one skilled in the art.

Figure 2:
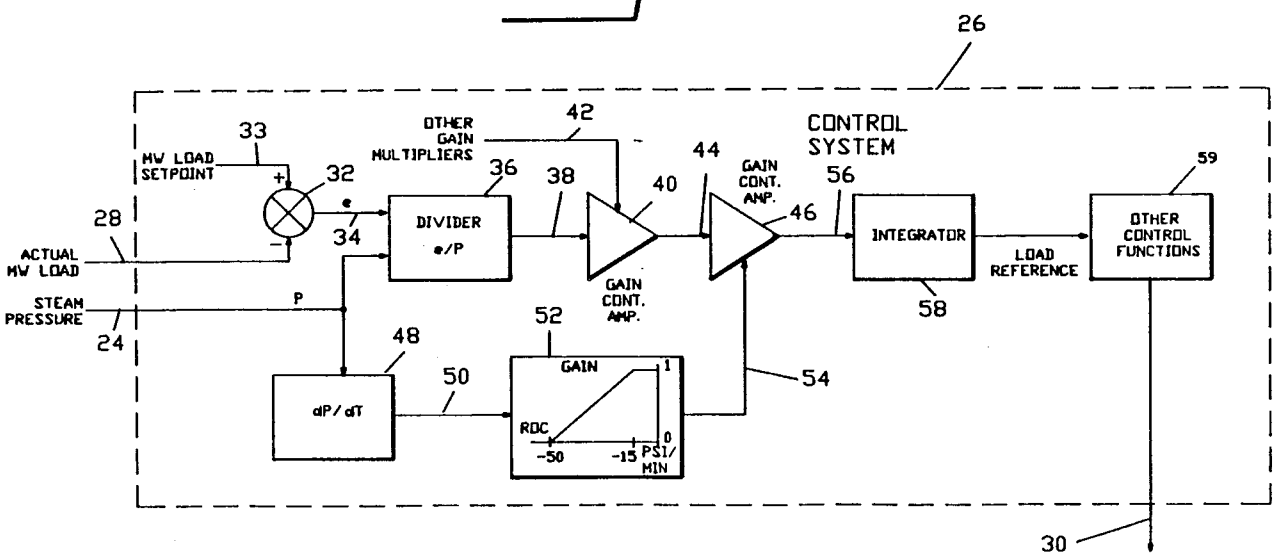
FIG. 2 is a simplified schematic diagram of a portion of a control system of the present invention.

Referring now to FIG. 2, control system 26 contains a subtractor 32 receiving a megawatt load setpoint signal on a line 33 at its plus (+) input and the signal representing the actual megawatt output of electric generator 20 on megawatt output feedback line 28 at its minus (−) input. Subtractor 32 produces an error signal e, equal to the difference between its inputs, for application on a line 34 to a first input of a divider 36. The steam pressure feedback signal P on steam pressure feedback line 24 is fed to a second input of divider 36. Divider 36 divides the error signal by the steam pressure feedback signal (e/P) to produce a megawatt load reference error signal for application on a line 38 to an input of a gain-controlled amplifier 40. A gain-multiplier signal, whose origin is not of concern to the present invention, is applied on a line 42 to a gain-control input of gain-controlled amplifier 40. The gain of gain-controlled amplifier 40 is varied between zero and one by the amplitude of the signal at its gain-control input.

The output of gain-controlled amplifier 40 is applied on a line 44 to an input of a second gain-controlled amplifier 46. The steam pressure feedback signal on steam pressure feedback line 24 is also fed to the input of a differentiator 48 which calculates the rate of change of steam pressure with time. The derivative thus formed is applied on a line 50 to an input of a gain function generator 52. An output of gain function generator 52 is applied on a line 54 to a gain-control input of gain-controlled amplifier 46. The output of gain-controlled amplifier 46 is applied on a line 56 to an input of an integrator 58. The output of integrator 58 is an input to other control functions 59 of the control system which furnishes the control signal applied on control line 30 to steam control valve 14 (FIG. 1).

As illustrated by the graphic within it, gain function generator 52 is responsive to negative values of rate of change of steam pressure having a value less than a predetermined value to produce a signal effective to reduce the gain of gain-controlled amplifier 46 from 1 to 0. In the normal range of steam pressure derivatives less than the predetermined value, including the range greater than the predetermined value, and all positive values, the gain-control signal applied to gain-controlled amplifier 46 remains 1. Between the predetermined value and an extreme negative value of the derivative, the signal produced by gain function generator 52 progressively reduces the gain of gain-controlled amplifier 46 from 1 to 0 along a linearly sloping curve. Although the inventors do not intend to be limited to a particular set of values, in one embodiment, the predetermined value beyond which gain control is assumed by gain function generator 52 is about −15 PSI per minute. In this embodiment, the extreme value beyond which the gain of gain-controlled amplifier 46 is controlled to zero is about −50 PSI per minute.

In some applications, the linear relationship between gain control and negative derivative may be replaced by some other function. For example, instead of the smooth proportional relationship illustrated, a stepwise linear relationship may be employed. Alternatively, a non-linear relationship between the negative derivative of steam pressure and the gain of gain-controlled amplifier 46 may be superior, and should be considered to fall within the spirit and scope of the present invention.

As will be now evident to one skilled in the art having the present disclosure for reference, the effect of sudden reductions in steam pressure are dampened or eliminated by the present invention. All pressure rates of change above the predetermined limit (−15 PSI/minute in the illustrative embodiment) are considered to fall within the normal range and are unaffected by the present invention.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What we claim is:

1. A control system for controlling a steam turbine-generator using megawatt feedback, comprising:

means for producing a load reference error;

control means responsive to said load reference error for controlling an amount of steam fed to said turbine;

means for producing a rate of change signal responsive to a rate of change of a steam pressure in said steam turbine-generator; and gain control means responsive to a value of said rate of change signal indicating a negative rate of change less than a predetermined value for reducing said load reference error, whereby a loading of said steam turbine-generator is rendered relatively unresponsive to steam-pressure reductions exceeding said predetermined value.

2. A control system according to claim 1 wherein said gain control means further includes means for controlling a gain of said control means in a linear relationship to a reduction in negative values of said rate of change signal, when said value is less than said predetermined value.

3. A control system according to claim 2 wherein said gain control means further includes means for controlling said gain to zero at a second predetermined value of said negative values having an value less than the first-mentioned predetermined value.

4. A method for controlling a steam turbine-generator using megawatt feedback, comprising:

producing a load reference error;

controlling an amount of steam fed to said turbine responsive to said load reference error;

producing a rate of change signal responsive to a rate of change of a steam pressure in said steam turbine-generator; and reducing said load reference error in response to a value of said rate of change signal indicating a negative rate of change less than a predetermined value, whereby a response of said steam turbine-generator is rendered relatively unresponsive to steam-pressure reductions exceeding said predetermined value.

* * * * *